US006755494B2

(12) United States Patent
Park

(10) Patent No.: US 6,755,494 B2
(45) Date of Patent: Jun. 29, 2004

(54) INK-JET PRINTER FOR DIGITAL TEXTILING

(75) Inventor: Sang-up Park, Chonju (KR)

(73) Assignee: Yetek Co., Ltd., Chonju (KR)

( * ) Notice: Subject to any disclaimer, the term of this patent is extended or adjusted under 35 U.S.C. 154(b) by 0 days.

(21) Appl. No.: 10/168,929

(22) PCT Filed: Dec. 13, 2000

(86) PCT No.: PCT/KR00/01451

§ 371 (c)(1),
(2), (4) Date: Jun. 25, 2002

(87) PCT Pub. No.: WO01/49504

PCT Pub. Date: Jul. 12, 2001

(65) Prior Publication Data

US 2002/0191036 A1 Dec. 19, 2002

(30) Foreign Application Priority Data

Dec. 29, 1999 (KR) ..... 1999/64507

(51) Int. Cl.[7] ..... B41J 3/00; B41J 2/01
(52) U.S. Cl. ..... 347/4; 347/104
(58) Field of Search ..... 400/635, 23–49; 347/104, 4

(56) References Cited

U.S. PATENT DOCUMENTS 5,277,507 A * 1/1994 Garcia-Cano et al. ..... 400/631
6,095,628 A * 8/2000 Rhome ..... 347/4
6,332,680 B1 * 12/2001 Ozawa ..... 347/104

FOREIGN PATENT DOCUMENTS

| | | | |
|---|---|---|---|
| JP | 63258329 A | * 10/1988 | ..... 271/35 |
| JP | 02-241749 | 9/1990 | |
| KR | 86-6237 U | 6/1986 | |
| KR | 93-19997 U | 9/1993 | |
| WO | WO 97/11850 | * 4/1997 | ..... 347/104 |

* cited by examiner

*Primary Examiner*—Thinh Nguyen
*Assistant Examiner*—Julian D. Huffman
(74) *Attorney, Agent, or Firm*—Collard & Roe, P.C.

(57) ABSTRACT

The present invention relates to an ink-jet printer for digital textile printing, especially relates to an ink-jet printer, the transporting method of which uses a flat table (a transporting table) instead of a conventional roll. The present invention employs a flat table transporting method in which an object to be printed is placed on a flat table of specified size, thereby can be printed in various forms regardless of their appearances or thickness. The present invention provides an ink-jet printer having a transporting part to transport an object to be printed through a path and printing part to perform the desired digital printing by jetting ink drops to the transported object, characterized in that the transporting part comprises: (a) transporting table on which the object is fixed and with which the object is transported; (b) a transporting means for transporting the table to the printing part; and (c) a driving means for operating the transporting means.

8 Claims, 5 Drawing Sheets

INK-JET PRINTER FOR DIGITAL TEXTILING

CROSS REFERENCE TO RELATED APPLICATIONS

Applicant claims priority under 35 U.S.C. §119 of Korean Application No. 1999/64507 filed Dec. 29, 1999. Applicant also claims priority under 35 U.S.C. §365 of PCT/KR00/01451 filed Dec. 13, 2000. The international application under PCT article 21(2) was published in English.

BACKGROUND OF THE INVENTION

The present invention relates to an ink-jet printer for digital textile printing, especially relates to an ink-jet printer, the transporting method of which uses a flat table (a transporting table) instead of a conventional roll. The present invention employs a flat table transporting method in which an object to be printed is placed on a flat table of specified size and thereby can be printed in various forms regardless of their appearances or thickness.

BACKGROUND ART

Textile Printing

Conventional textile printing is usually carried out by a screen print or a roller print where a plate-making process is mandatory. However, it is difficult to catch-up with the trend and also it is not suitable for small quantity production of multi-products because the dyeing process is rather complicated. To meet those criteria, digital printing method in which a full-size printer prints on textile directly was developed and has been applied to textile industry domestically and abroad.

Digital printing method, which was considered as a revolution in dyeing technology, has been introduced in Korea in mid 1990s. This method makes it possible to reproduce the original design no matter how complicated its form is, and to print colors, which is difficult to express previously. Moreover, in the sample production, it is revolutionary in its production ability and effectiveness in that it takes only 10 minutes to produce samples with a digital printer whereas it normally took approximately 10 days with an existing printing machine. It also excels in design express, design change, color presentation compared to the existing printing machine. Different from previous method, digital printing has almost no limit in expressing design because one can directly print out his or her design created in computer and dye on textile. Changes of a design can also be done by a simple operation of a computer program in digital printing unlike the conventional methods. Also 16,700,000 colors can be expressed using a digital ink-jet printer whereas the conventional methods use approximately 30 colors of combination to express colors.

In economical aspect, digital printing contributes to a production cost reduction because small amount of textile is used to produce sample cloth before the studies on a market reaction. Then, it is possible to focus on highly possible items and produce it in real time leading to a decreased textile stock and eventually to a production cost reduction. In terms of manufacturing facility, a digital type ink-jet printer can be used in a regular office. After printing, steaming and washing processes can be either out-sourced or can be performed using it facilities.

As a result, digital printing meets the current market demands such as independent demands on designs or a flexible response to a market trend, thereby draws attention of people in textile related business, and an accelerated development in this area is expected.

Digital Textile Printer

Early printer with digital printing method could only be applied to special kind of textile that does not wrinkle inside the printer and cost $25–30 per square meter therefore could not be used to produce textile in large quantities and were used to make only sample clothes. Recently, however, printing using a printer has been increased following the development of large sized printers that can print on common textile.

Foreign manufacturers such as Mamaki and M-cad mostly make currently marketed textile printers. Textile printer "TX1600" from Mamaki, Japan, prints at the rate of 5 m per hour, however, is suitable for small quantity production of multi-products such as neckties and scarves. It is exported to Europe and USA, and is becoming popular in Korea. But this type of large printer is difficult to be commercialized due to its high price.

Also many world-class equipment manufacturers are focusing on developing digital ink-jet printer, as digital printing becomes the matter of interests in the textile industry. The printer manufacturers who offered the ink-jet printers by mid 1999 are Stork of Netherlands, Perfecta of Swiss, KC, DGS and Sophis of Belgium, Ichnose, Lectra, and Kanebo, etc. and among them, KC, DGS, and Sophis used printers manufactured by Mamaki and Stork by Konica.

Stork recently announced a regular full-scale production of a digital printer that can produce 17 m per hour. Currently they are manufacturing three different types of digital printer: Amethyst, Zircon, and Amber. Amethyst is suitable to produce natural fiber, silk, cotton, and rayon and prints on 1.6 m wide textile at the rate of 16 m per hour. Zircon is mainly for polyester and prints on 1.6 m wide textile at the rate of 7 m per hour. Amber can print on natural fiber but has demerits that its printing speed is 4 m per hour.

Recently a Korean company announced a development of a printer that can print on 1.8 m wide textile. However, despite the active development and improvements in efficiency, there are still many problems to be solved such as the limit of the width of the textile and color fastness of finished products.

Particularly, the ink-jet printers developed so far have been able to print on objects only at certain sizes and shapes and able to textile only with fixed width of 1.6 m, 1.7 m, and 1.8 m, etc. That is, as illustrated in FIG. 1, a paper path (101) in U form is formed spanning from a feeding unit (a) to a delivering unit (b) in a conventional ink-jet printer. An ink-jet head (102) is placed in an inking unit (c) within the paper path (101). This ink-jet head(102) moves to the direction perpendicular to the center of a paper surface by a carrier not described here, and is constructed to perform the desired inking as jetting ink drops. Feed roller (103) is installed in the paper path (101) and makes cassette paper or manually supplied paper from the paper tray (106) to be dispatched to an inking unit (c).

Conventional ink-jet printer used feed roller (103) installed inside the printer as a driving device to transport the printing object, and this roller transports the objects to be printed such as a paper or textile smoothly. Also there was a restriction in selecting the objects to be printed since it was required that the objects should have certain sizes (A4, A3, B5, textile with fixed width, etc.) so that the ink-jet head (102), the printing device, recognizes the zero point.

Therefore, there has been a restriction in its application when a conventional textile ink-jet printer was used in that it cannot directly print on clothes that are cut into various forms or finished textile products or goods such as wallet, bag, shoes, and cup made of various materials.

SUMMARY OF THE INVENTION

The present invention is devised in order to overcome the limits of the conventional method. It is the object of present invention to provide an ink-jet printer that can print on objects regardless of its shapes whereas conventional ink-jet printers can only print on objects with specified shapes.

It is another object of the present invention to provide an ink-jet printer that can dye directly in a digital mode textile products such as clothes, scarf and handkerchiefs made in various shapes.

It is still another object of the present invention to provide an ink-jet printer which can print on almost all the materials around us such as wood, leather, synthetic leather, plastics, glass, stone, ceramic or metal in addition to textile.

It is another object of the present invention to provide an ink-jet printer which can print on objects made of various materials such as wallets, bags, shoes, stationary, frames, ornaments, cup, kitchen utensils or articles made of glass regardless of their thickness or shapes.

In order to achieve the above objectives, the present invention overcomes the conventional feed roller printing method and switches over to the flat table transportation method in which an object to be printed is placed on a flat table of a fixed size and then the flat table is transported. This method enables the printer to recognize the flat table as an object to be printed, thereby prints on objects with different shapes by controlling the thickness and structure of the transporting table.

The present invention provides an ink-jet printer having a transporting part to transport an object to be printed through a path and printing part to perform the desired digital printing by jetting ink drops to the transported object, characterized in that the transporting part comprises: (a) transporting table on which the object is fixed and with which the object is transported; (b) a transporting means for transporting the table to the printing part; and (c) a driving means for operating the transporting means.

BRIEF DESCRIPTIONS OF THE DRAWINGS

DETAILED DESCRIPTION OF THE INVENTION

A more detailed explanation of the present invention will be described below using the figures attached.

Figure 1:
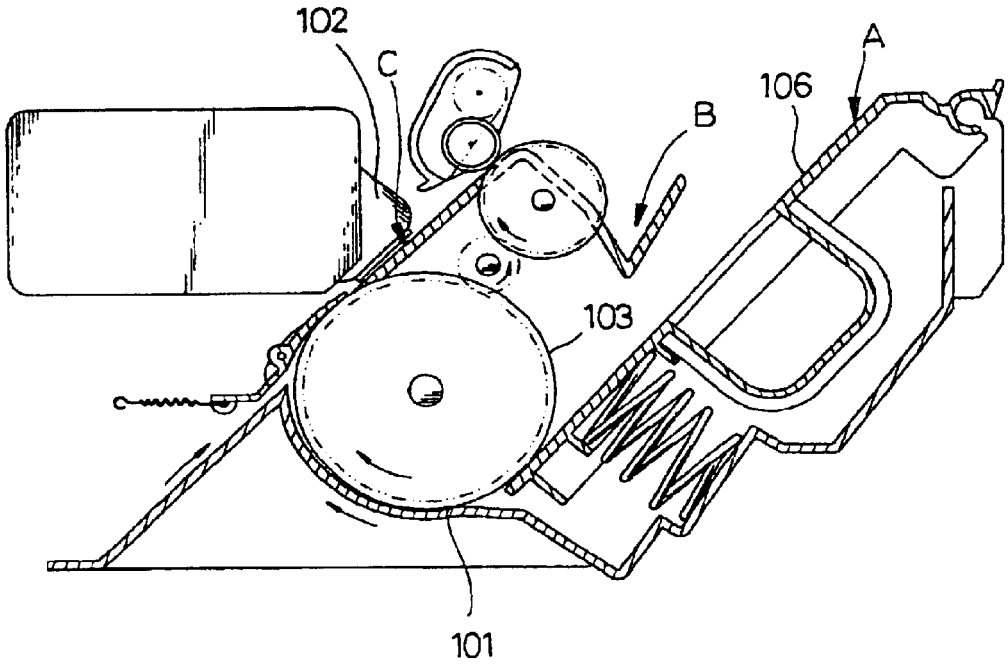
Fig. 1 Prior Art
FIG. 1 is a profile view according to a schematic construction of one example of a conventional ink-jet printer in a related technology.
Figure 2:
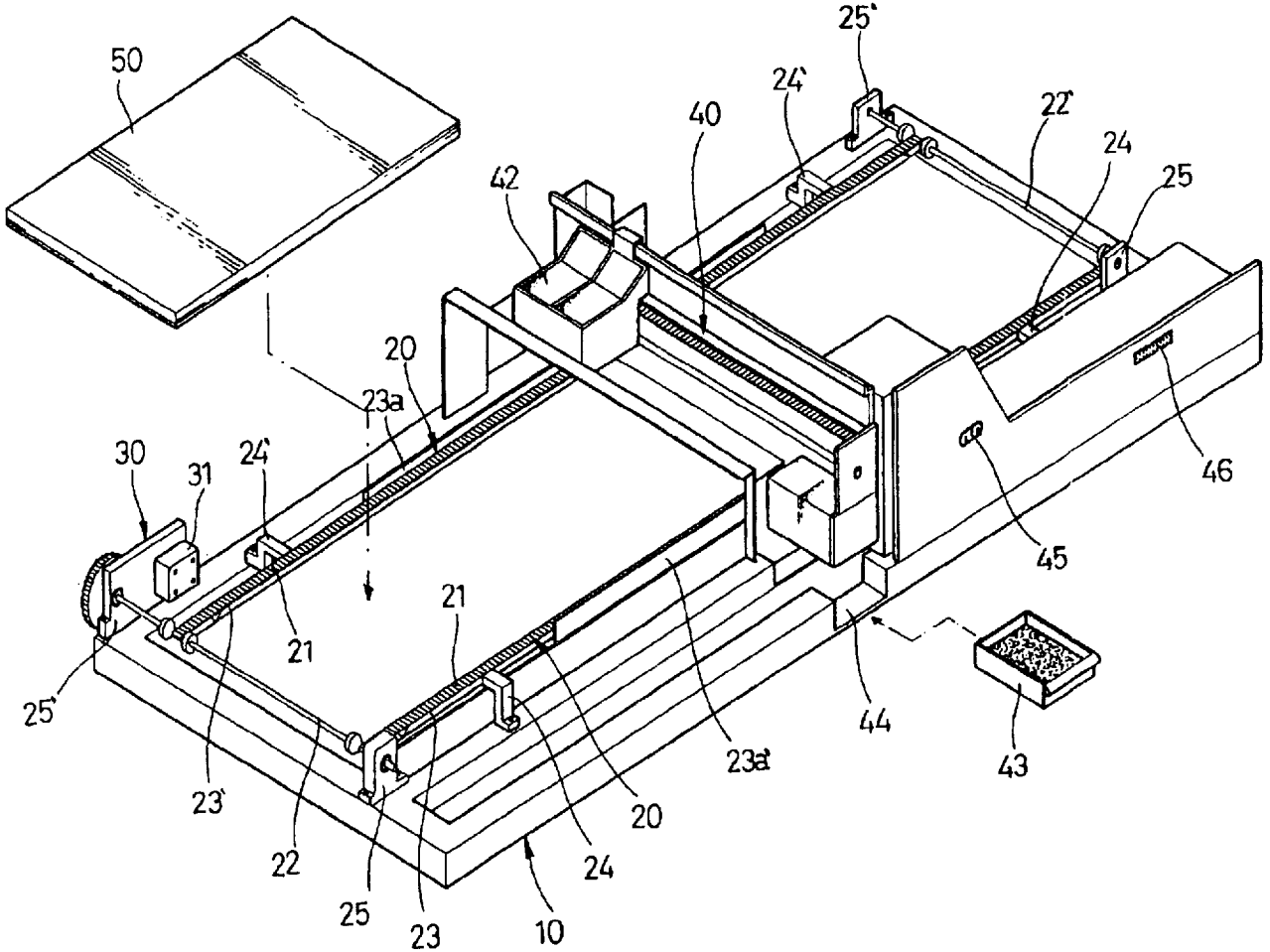
FIG. 2 is a perspective view of the entire construction of an ink-jet printer for digital printing according to the present invention.
Figure 3:
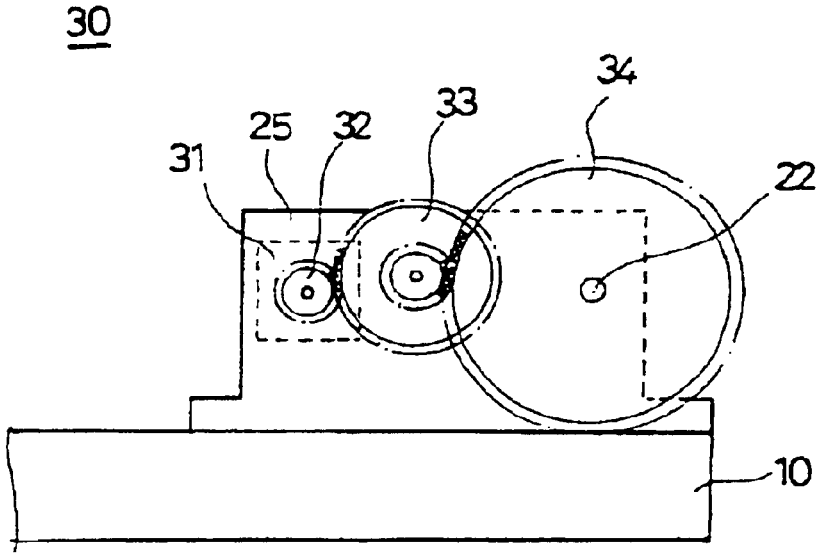
FIG. 3 is a front view of the driving part of the ink-jet printer for digital printing according to the present invention.

FIG. 2 illustrates the structure of the ink-jet printer according to the present invention. The ink-jet printer according to the present invention comprises a rectangular frame (10), a transporting part set up along the length of the frame (10), and printing part set up at the approximately halfway of the transporting part, wherein the transporting part comprises a transporting table (50) on which an object to be printed is fixed and with which the object is transported; a transporting means (20) on which the transporting table (50) is placed for transporting the table to the printing part; and a driving means (30) for operating the transporting means(20). And then the transporting table (50) on which the object is fixed is transported to the printing part by the operation of the driving part (30) and an ink-jet head (40) performs the desired digital printing by jetting ink drops to the object.

The ink-jet printer according to the present invention additionally comprises an entry sensing device (not shown in the figure), a sensor that is installed inside the printing part and senses whether or not the transporting table (50) is entered into the printing part then sends out the operation signal to an ink-jet head (40). The transporting means (20) of the present invention is where Cateroillar-type endless track conveyer belts (21) (21') are installed parallel to both the right and left sides. At the front and rear ends of the conveyer belt (21) (21') a rotating axis (22) (22') fixed by bearing supporter (25) (25') is installed and the conveyer belt (21) (21') is rolled up here. Between the rotating axes (22) (22'), a sag carrier (23) (23') is installed to prevent the sagging of the conveyer belt (21) (21)

It is desirable to manufacture the above sag carrier (23) (23') using the square lumber whose width is the same with that of the conveyer belt (21)(21'). This sag carrier (23)(23') is kept at a certain height over a frame (10) by supporting brackets (24)(24') made up in a crank form and is placed at the side of the sag carrier (23)(23'), thereby effectively prevents the lowering of the conveyer belt during a printing process. The front and rear ends of a sag carrier (23)(23') are tapered toward the bottom; therefore do not interrupt the rotation of the conveyer belt (21)(21').

The unexplained part 42 is a cartridge that contains a printing dye, 43 is a dye container to receive the dye remained after the printing, 44 is a storing part to store the dye container, 45 is a power cord input terminal, and 46 is a cable input terminal for a connection to a computer.

Dye for general ink-jet printing can be used for the printer of the present invention. In particular, it is desirable to use ink made of a reactive dye and aqueous liquid medium but it is not limited to them. Reactive dye normally includes 4 colors such as reactive red, reactive yellow, reactive blue and reactive black, but for more delicate expressions, reactive orange, reactive brown, reactive green, reactive violet can be selectively included to make it 6 colors total. Moreover, if edible ink is used as a dye, it is possible to print on food (such as bread, cookie, rice cake, instant noodles, etc.) and it is also possible to print on finished products made of various materials (iron, stone, wood, plastic, glass, leather, etc.) using oily ink.

As illustrated in FTC. 3, the driving means (30) to operate the conveyer belt above (21) (21') comprises a driving gear (32) that is installed on a rotating axis of the driving motor (31), a first deceleration gear (33) that is joined to a driving gear (32), a second deceleration gear (34) that is joined to a first deceleration gear (33) and to one side of the front end rotating axis (22) The driving means (30) is fixed to a bearing supporter (25') to support the above rotating axis (22).

Figure 4:
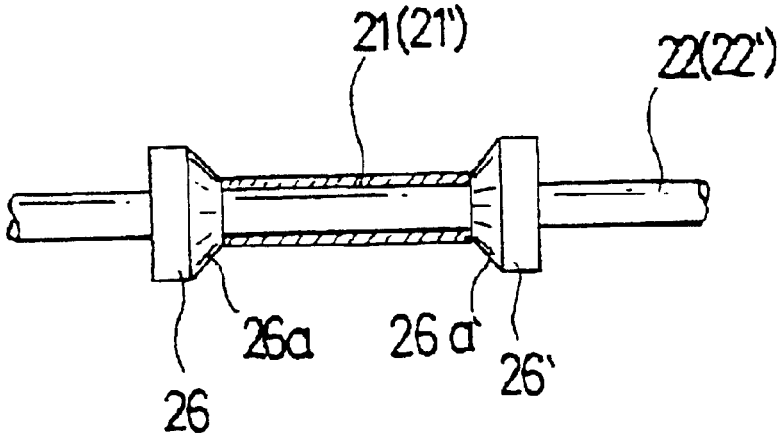
FIG. 4 is a cross sectional view of the transporting part of the ink-jet printer for digital printing according to the present invention.

As illustrated in FIG. 4, in a rotating axis (22) installed at the front and rear ends of the conveyer belt (21)(21), a guide (26)(26') is placed inside the tapered surface **(26*a*)(26*a'*) to hold the home position of conveyer belt (21)(21'), and is fixed opposite to each other at the left and right sides of the conveyer belt (21)(21') fitting to the width of the conveyer belt (21)(21') therefore maintains a smooth rotation of the conveyer belt (21)(21')**.

In the present invention, a restraining carrier **(23*a*)(23*a'*) is installed at the outer side of a sag carrier (23)(23') for a straight drive of transporting table (50)**

In FIG. 2, a transporting table (50) whose top is flat is illustrated. This transporting table satisfies the size of the objects to be printed for a printer, for example A3 and A4, etc., and the objects to be printed are placed on a transporting table (50) by a fixing device. General purpose fixing devices including easily available adhesive tapes, pushpins or magnets can be used.

Figure 5:
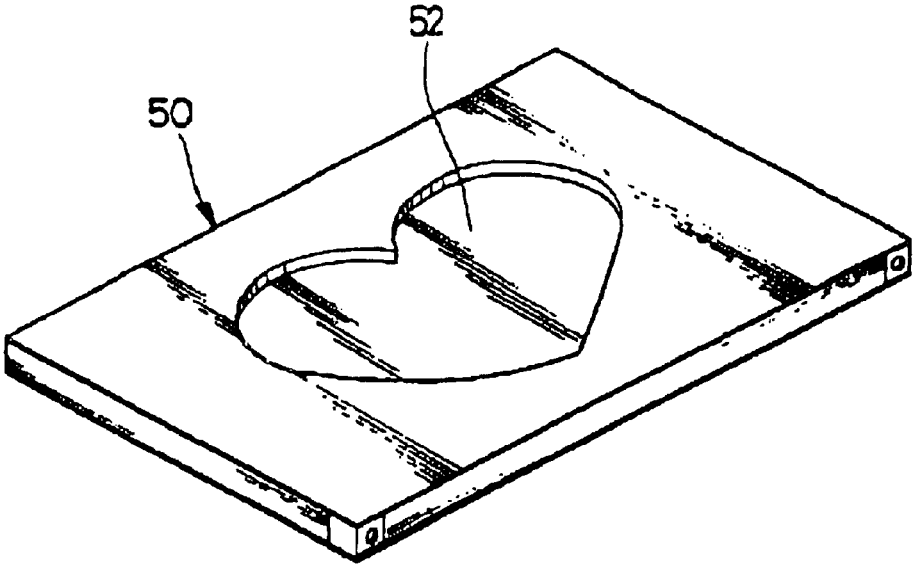
FIG. 5 is another example of a transporting table of the ink-jet printer for digital printing according to the present invention.

FIG. 5 illustrates another example of a transporting table (50) according to the present invention. With the textile ink-jet printer of the present invention, if objects such as wood, leather, plastic, stone, glass, etc. are printed, they can be fixed to a transporting table (50) by forming a landing slot (52) according to the shape of an object to be printed, thereby enables the object to be placed on the transporting table without special fixing device.

The structure of a transporting table in FIG. 2 and FIG. 5 shows one example according to the present invention and it is possible to form various types of landing slots (as in printing a shoe) and to change the structure of the topside matching the shapes of the object to be printed. Also various types of fixing devices can be connected to the transporting table to fix the object to be printed and the materials for the transporting table can be diversely selected according to the objects. Therefore, when printing with the textile printer of the present invention, it is possible to print on any objects regardless of its thickness, size, and shape by adjusting the size, thickness, slot, structure of the topside, materials of the transporting table.

The objects that can be printed by this textile printer includes products (wallets, shoes, bags, stationary, cups or ornaments) made of wood, leather, synthetic leather, plastic, stone, glass, ceramic or metal not to mention the parts of clothes cut into various forms such as front and rear side, sleeve, collar of finished textile products such as t-shirts, blouses, cardigans, or skirts. Also, if edible ink is used as a dye, foods such as breads; cakes; cookies; candies; rice cakes or instant noodles, can be printed.

The printing process using the printer of the present invention is as follows. In first, a design to be printed is made up and is edited using an exclusive program in computer and then a computer is connected to the printer of the present invention and then it is printed. Choose a suitable transporting table that the printer requests (A3, A4, etc.) and fix the object to be printed on the top of the table. Place the transporting table (50) on a transporting means (20) of the printer, that is, on a conveyer belt (21)(21').

Next, a printer which receives a print signal from the computer approves a driving stand-by signal for a printing part and sends out the driving signal to a driving part simultaneously so that the transporting table moves to the printing part, that is an ink-jet head (40).

Once the transporting table (50) enters into the ink-jet head (40), a ink-jet head (40) on driving stand-by state performs printing operation on an object fixed on a transporting table and the object moves at the rate of printing. At this time, the ink-jet head (40) recognizes the transporting table (50) as an object to be printed and identifies the zero point and searches for the spot to print, therefore the printing operation can be done regardless of the sizes and shapes of an object to be printed.

When printing is completed, the transporting table exits the printing part and the ink-jet head (40) go back to its stand-by state. As the transporting table completely exits from the printing part, an applied driving signal is discontinued and the printing part will be in a stand-by state for a next job.

Meanwhile, the objects that are finished with the printing go through post processes such as steaming and washing. Then the whole dyeing process is completed.

The printer of the present invention can be used to print on various forms of textile products such as clothes, scarves or handkerchiefs as well as almost all common materials such as wood, leather, synthetic leather, plastic, glass, stone, ceramic, and metal regardless of their thickness and shapes. In particular, it can directly print on finished products such as t-shirts, blouses or skirts as well as on clothes that are cut into each piece. It can also print on wallets, bags, shoes, stationary, frames, ornaments, cups, kitchen utensils or glassware made of various materials and even on foods such as bread, cake, cookie, candy, rice cake or instant noodle as long as edible ink is used as a dye.

As described above, the printer of the present invention reflects the requests from various users; therefore it can print what consumers desire such as specific drawing, picture, character, design or photos of entertainers on various products.

Industrial Applicability

As described above, the present invention relates to an ink-jet printer, changed from a conventional feed roller method to a flat table transporting method. The ink-jet printer of the present invention overcomes limits of objects to be printed that the conventional ink-jet printer with roller supply method has and can print on objects effectively regardless of the materials, sizes, and shapes. Moreover, the printer of the present invention can be used for the quick printing on finished products such as various decorations, stationary, ornaments that are sensitive to current trend and experience quick trend changes.

What is claimed is:

1. An ink jet printer comprising a transporting part to transport an object to be printed through a path and a printing part to print designs by jetting ink drops to the transported object, wherein the transporting part comprises:

(a) a transporting table on which the object is fixed and with which the object is transported, said transporting table comprising a flat table of a specified size satisfying a printer request, and having a top side with an adjustable thickness and structure to match shapes of the object to be printed;

(b) a transporting means for transporting the table to the printing part, said transporting means comprising an endless track type conveyor belt; a rotating axis installed at front and rear ends of said conveyor belt; and a sag carrier installed between the rotating axes to prevent lowering of the conveyor belt, wherein the transporting table is placed on the conveyer belt while transported to the printing part; and (c) a driving means for operating the transporting means.

2. An ink-jet printer according to claim 1, wherein the rotating axis has a guide with a tapered side which is fixed symmetrically on left and right sides of the conveyer belt and matches a width of the conveyer belt to maintain a home position of the conveyer belt.

3. An ink-jet printer according to claim 1, further comprising a restraining carrier installed at an outer side of the sag carrier for straight driving of the transporting table.

4. An ink-jet printer according to claim 1, by further comprising a land slot formed to match the shape of the object to be printed on top of the transporting table.

5. An ink-jet printer according to claim 1, wherein the object to be printed is a finished textile product.

6. An ink-jet printer according to claim 1, wherein the object to be printed is selected from the group consisting of wallets, bags, shoes, stationary, frames, ornaments, cups, and kitchen utensils.

7. An ink-jet printer according to claim 1, wherein the material of the object to be printed is selected from the group consisting of wood, leather, synthetic leather, plastic, glass, stone, ceramic, and metal.

8. An ink-jet printer according to claim 1, wherein the object to be printed is a finished food product.

* * * * *